US007347186B2

(12) United States Patent
Ricco et al.

(10) Patent No.: US 7,347,186 B2
(45) Date of Patent: Mar. 25, 2008

(54) HIGH-PRESSURE PUMP FOR A FUEL, WITH SUMP IN COMMUNICATION WITH THE FUEL

(75) Inventors: Mario Ricco, Casamassima (IT); Sisto Luigi De Matthaeis, Valenzano (IT); Annunziata Anna Satriano, Valenzano (IT); Sergio Stucchi, Valenzano (IT)

(73) Assignee: C.R.F. Societa' Consortile per Azioni, Orbassano (IT)

( * ) Notice: Subject to any disclaimer, the term of this patent is extended or adjusted under 35 U.S.C. 154(b) by 86 days.

(21) Appl. No.: 11/392,847

(22) Filed: Mar. 29, 2006

(65) Prior Publication Data

US 2007/0144488 A1 Jun. 28, 2007

(30) Foreign Application Priority Data

Dec. 27, 2005 (EP) ..... 05425922

(51) Int. Cl.
*F02M 57/02* (2006.01)
*F04B 17/00* (2006.01)

(52) U.S. Cl. ..... 123/446; 417/366

(58) Field of Classification Search ..... 123/445, 123/495, 446, 447; 417/366
See application file for complete search history.

(56) References Cited

U.S. PATENT DOCUMENTS 3,989,487 A * 11/1976 Peterson ..... 96/242
4,301,777 A * 11/1981 Grundman et al. ..... 123/379
4,476,836 A * 10/1984 Enomoto et al. ..... 123/502
5,630,708 A * 5/1997 Kushida et al. ..... 417/273
5,967,123 A * 10/1999 Ruoff et al. ..... 123/495
6,009,854 A * 1/2000 Rosgren et al. ..... 123/456
6,196,191 B1 3/2001 Rembold et al.
6,345,609 B1 * 2/2002 Djordjevic ..... 123/509
6,422,212 B1 7/2002 Faix et al.

(Continued)

FOREIGN PATENT DOCUMENTS

DE 199 33 569 1/2001
DE 102 59 178 7/2004
EP 1 464 826 10/2004

*Primary Examiner*—Thomas Moulis
(74) *Attorney, Agent, or Firm*—Ladas and Parry LLP

(57) ABSTRACT

The pump (7) is provided with a body (16) having a compartment (17), and with at least one pumping element (13) that moves in a cylinder (12) in communication with the compartment (17), to raise the pressure of the fuel. The pump (7) comprises fluid-supply means (14, 22) for delivering the fuel to the pumping element (13), and an inlet mouth (26) made in the body (16) and supplied with the fuel coming directly from an external source (2). The inlet mouth (26) is fluidically connected to the compartment (17) to supply it with the fuel in order to lubricate and/or cool the pump (7) itself. Set between the inlet mouth (26) and the compartment (17) are: a non-return valve (33) to prevent in any case the pumping elements (13) from sucking the fuel from the compartment (17) of the body (16); and a flow regulator (29'), which allows an amount of fuel to pass such as to enable proper lubrication and cooling of the compartment (17) and of the parts present in the compartment (17). The fluid-supply means (14, 22) comprise at least one further inlet mouth (24) made in the body (16) and fluidically connected with the pumping element (13) by means of pipes (9).

10 Claims, 2 Drawing Sheets

Figure 1:
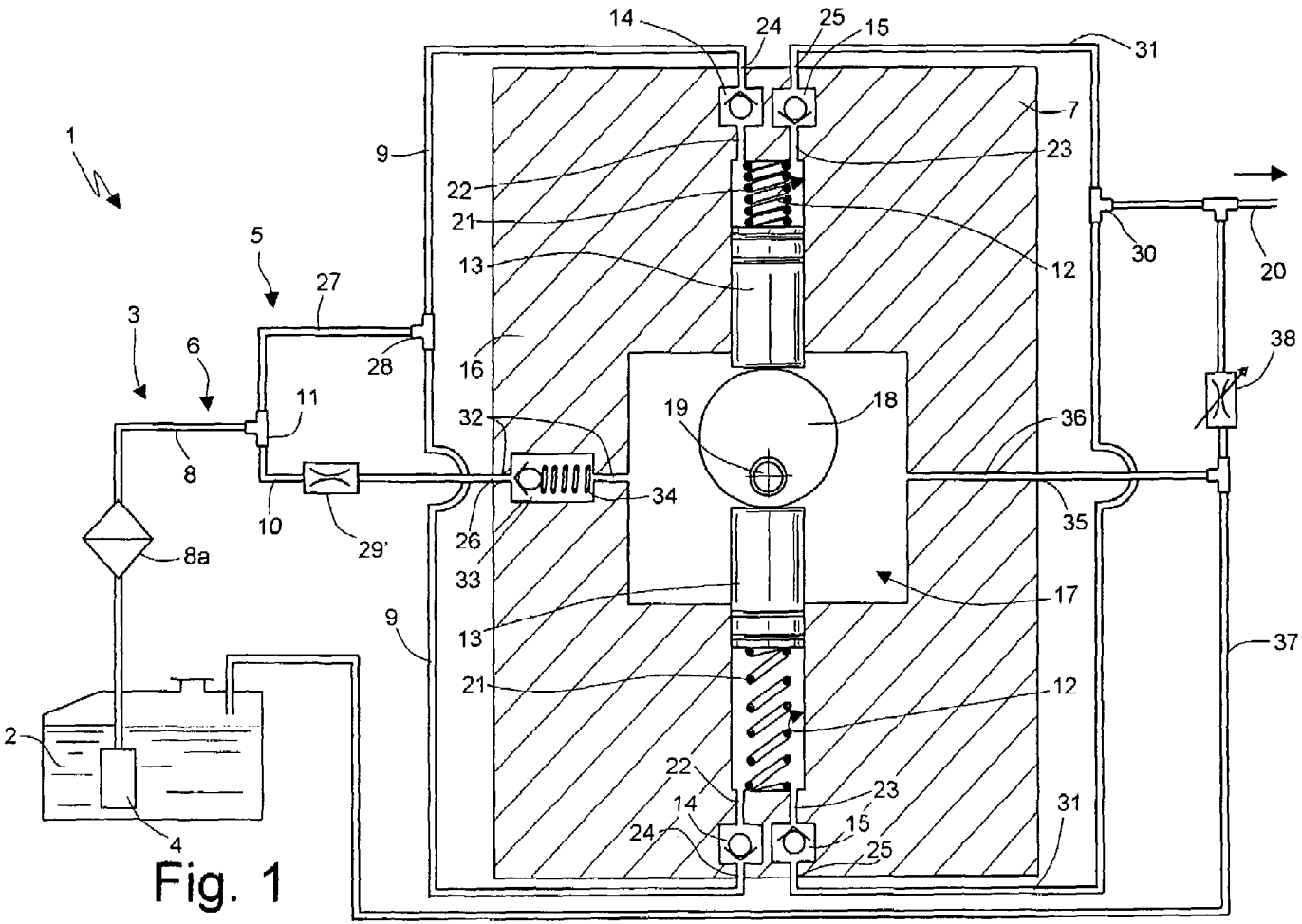

U.S. PATENT DOCUMENTS 6,694,950 B2 * 2/2004 Djordjevic ..... 123/446
6,817,841 B2 * 11/2004 Frank et al. ..... 417/273
2002/0189436 A1 * 12/2002 Frank et al. ..... 92/61
2003/0108443 A1 * 6/2003 Suzuki et al. ..... 417/470

* cited by examiner

HIGH-PRESSURE PUMP FOR A FUEL, WITH SUMP IN COMMUNICATION WITH THE FUEL

The present invention relates to a high-pressure pump for a fuel, with sump in communication with the fuel, for supplying an internal-combustion engine, and to a compression assembly comprising said pump.

There are known, in the sector of internal-combustion engines, fuel-injection systems, comprising a fuel tank and a compression system fluidically connected to the tank itself and designed to make the fuel available to the engine at a pre-set pressure. The compression system generally comprises a low-pressure pump for supplying the fuel contained in the tank to a high-pressure compression assembly, which sends the fuel under pressure, possibly via a common rail, to a plurality of injectors associated to the cylinders of the engine.

The high-pressure compression assembly comprises a high-pressure pump and a distribution circuit set between the low-pressure pump and the high-pressure pump. More precisely, the high-pressure pump has a body, generally made of cast iron, within which a compartment, called "sump", is provided. Housed in the sump is a plurality of pumping elements designed to compress the fuel, a portion of a shaft for governing the pumping elements, which is in turn driven by the internal-combustion engine or by an auxiliary motor, and one or more cams, designed to transmit the motion from the drive shaft to the pumping elements. Each pumping element is mobile with reciprocating motion in a corresponding cylinder and has an intake valve for intake of the fuel from the distribution circuit, and a delivery valve for sending the compressed fuel to the common rail.

In high-pressure pumps of a known type, a part of the fuel of the distribution circuit is used for lubrication and cooling of the sump, the drive shaft, the cams, and the pumping elements themselves. For this purpose, a pipe for delivery of the fuel coming from the distribution circuit traverses the body of the high-pressure pump and connects the sump to a single inlet mouth made in the body itself.

In a known type of high-pressure pump, a plurality of pipes for supplying the respective pumping elements branches off from the delivery pipe, in a position set between the inlet mouth and the sump, and extends as far as the respective pumping elements. In another known type of high-pressure pump, the delivery pipe does not present branchings, and a plurality of supply pipes is provided extending from the sump to the respective pumping elements. In these known compression assemblies, the engine, especially at high r.p.m., drives the shaft of the pump, causing a swirling motion in the fuel present in the sump, so disturbing the flow of the fuel to the pumping elements and causing a drop in the efficiency of the high-pressure pump. Furthermore, in the case where the fuel reaches the pumping elements after cooling the sump, it undergoes an increase in temperature with consequent reduction in density, which causes a reduction in volumetric efficiency of the pump. The fuel could also be contaminated by possible machining swarf and impurities generated by the detachment of parts of members that come into contact with one another. In such a circumstance, there could arise a faulty operation of the high-pressure pump and the need for burdensome and frequent interventions of maintenance.

It has been proposed to provide, on the distribution circuit of the high-pressure pump, a filter for capturing the impurities of the fuel taken in. However, for various reasons, there may occur in the system an interruption of the supply to the high-pressure pump, whilst the engine of the motor vehicle continues to turn and to actuate the pumping elements. For example, said interruption can be caused by a clogging of the aforesaid filter, or by the failure of the low-pressure pump, or also by a command issued by the driver. In these cases, there exists the risk of the pumping elements sucking in the fuel present in the sump. This then leads to stoppage of both lubrication of the mechanism and cooling thereof, so that the high-pressure pump could be irreparably damaged.

The aim of the present invention is to provide a high-pressure fuel pump, with the sump in communication with the fuel, for supplying an internal-combustion engine, which will be free from the drawbacks linked to the known high-pressure pumps specified above.

The aforesaid aim is achieved by a high-pressure pump, as defined in Claim 1. Said aim is also achieved by a fuel-compression assembly for an internal-combustion engine, as defined in Claim 8.

Figure 2:
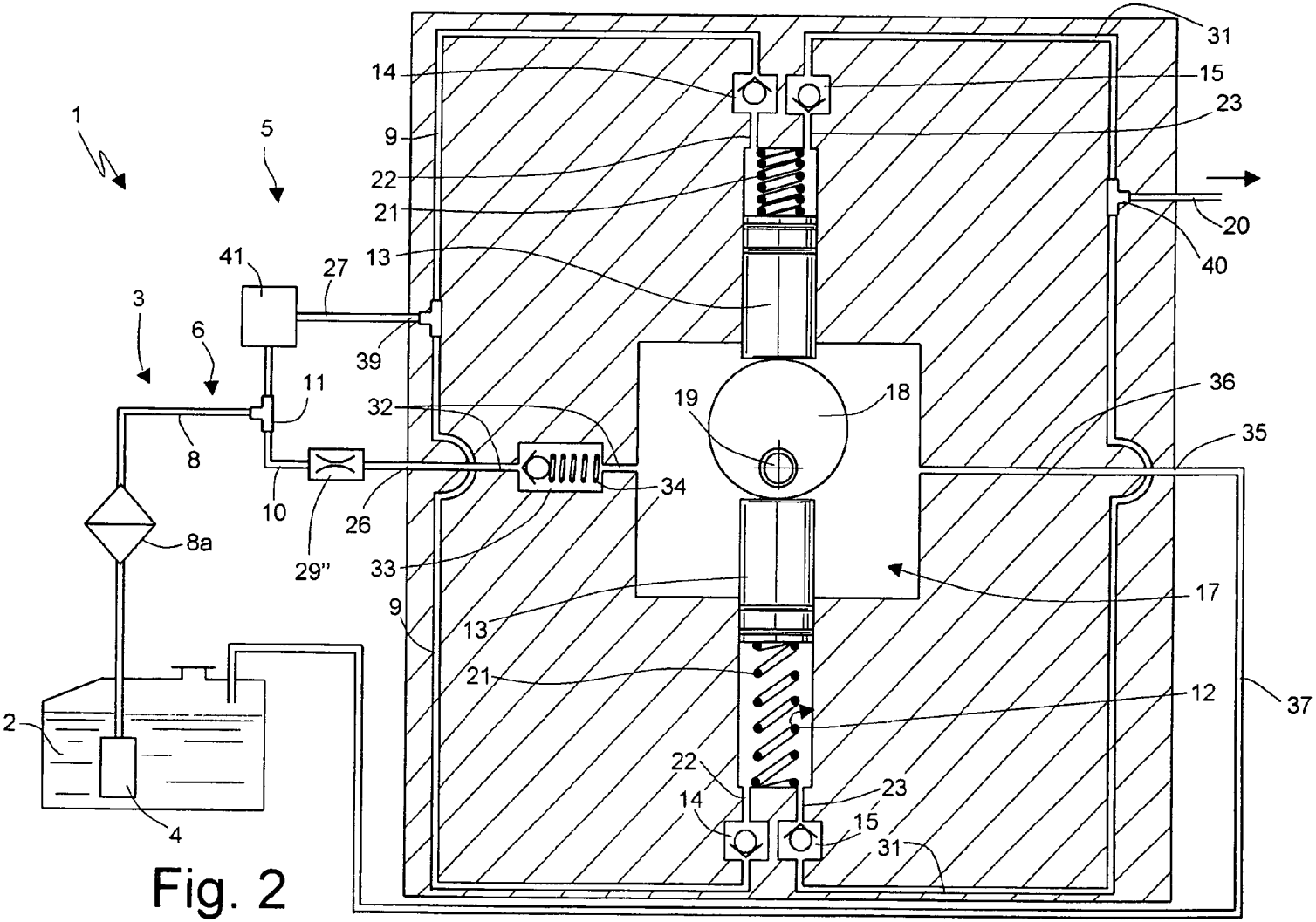

For a better understanding of the present invention, described herein are two preferred embodiments, purely by way of non-limiting example, with reference to the attached drawings, wherein:

FIG. 1 is a partial diagram of an injection system for an internal-combustion engine according to a first embodiment of the invention; and FIG. 2 shows a similar diagram according to another embodiment of the invention.

With reference to FIG. 1, the reference number 1 designates a partially illustrated injection system for an internal-combustion engine, in itself known and not illustrated.

The system 1 is illustrated only as far as it is necessary for an understanding of the present invention and basically comprises a tank 2 for the fuel, and a compression system 3, fluidically connected to the tank 2. The compression system 3 is designed to compress the fuel taken from the tank 2 to the desired pressure, to make it available to the internal-combustion engine.

In particular, the compression system 3 comprises a low-pressure pump 4 immersed in the fuel of the tank 2, and a compression assembly 5 fluidically connected to the low-pressure pump 4, to compress the fuel to a pre-set pressure value. The compression assembly 5 also comprises a circuit 6 for distribution of the fuel, fluidically connected to the low-pressure pump 4, and a high-pressure pump 7 supplied by the circuit 6 and fluidically connected to the internal-combustion engine.

The circuit 6 is preferably made of material with low thermal conductivity, and comprises a pipe 8 connected to the low-pressure pump 4, on which a filter 8*a* of the fuel is set. The circuit 6 moreover comprises one or more intake or supply pipes 9 (two in number in the example illustrated) for supplying the fuel to the high-pressure pump 7, and a lubrication and/or cooling pipe 10 for the high-pressure pump 7 itself. The pipe 8 connects the low-pressure pump 4 to a union tee 11, in fluid communication with the pipes 9 and with the lubrication and/or cooling pipe 10.

The high-pressure pump 7 comprises one or more pistons or pumping elements 13 (two in number in the example illustrated) each mobile with reciprocating motion in a corresponding cylinder 12, for compressing the fuel to the required high pressure. Each cylinder 12 has an intake valve 14 for delivery of the fuel to be compressed, coming from the corresponding supply pipe 9, and an exhaust valve 15 for exit of the compressed fuel to the internal-combustion engine, through an outlet pipe 20 external to the high-pressure pump 7.

The high-pressure pump 7 is defined by a body 16, generally cast in thermoconductive material, for example cast iron. Made in a centroidal position within the body 16, is a compartment, hereinafter designated by the term "sump" 17, which is in communication with the cylinders 12. The pumping elements 13 are actuated, via a cam 18, by a drive shaft 19 operatively connected to the usual shaft of the internal-combustion engine. In particular, the cam 18 can be formed by a terminal portion of the drive shaft 19. Housed in the sump 17 are the drive shaft 19, the cam 18, and a portion of the pumping elements 13.

Housed in each cylinder 12 is a compression spring 21 acting on the pumping element 13 itself. Each cylinder 12 is fluidically connected to the respective intake valve 14 via an intake pipe 22, and to the respective exhaust valve 15 via an exhaust pipe 23. The pipes 22 and 23 are made within the body 16, which for each intake valve 14 has an inlet mouth 24 and for each outlet valve 15 an outlet mouth 25. The intake valves 14 and exhaust valves 15 are arranged within the body 16, in the proximity of the respective inlet mouth 24 and outlet mouth 25. The body 16 moreover has an inlet mouth 26 to enable, through the pipe 10, delivery of the fuel for cooling and lubrication of the sump 17.

According to the invention, the union tee 11 is connected to a connector pipe 27, which terminates with a further union tee 28, from which there originate the external supply pipes 9 of the pumping elements 13. The lubrication and/or cooling pipe 10 is provided with a flow regulator 29' with fixed cross section, set between the union tee 11 and the inlet mouth 26 of the body 16 of the high-pressure pump 7, i.e., on the outside of the body 16. The flow regulator 29' is sized so as to enable passage of a flow of fuel sufficient to lubricate and/or cool the sump 17 and the mechanisms 13, 18, 19 of the high-pressure pump 7 properly. In turn, the outlet pipe 20 is connected, via a union tee 30, to two delivery pipes 31, each fluidically connected to the respective outlet mouth 25, to enable exit of the compressed fuel from the respective pumping elements 13.

The lubrication and/or cooling pipe 10 is connected, through the inlet mouth 26 to a pipe 32, which is set inside the body 16 and terminates in the sump 17. Set on the pipe 32 is a non-return valve 33, which is consequently set in series with the flow regulator 29'. The non-return valve is normally kept open, against the action of a spring 34, under the action of the pressure of the supply fuel coming from the low-pressure pump 4. Furthermore, the body 16 has an outlet mouth 35 connected to an outlet pipe 36 inside the body 16. Fixed on the outlet mouth 35 is a recirculation pipe 37, designed to send the fuel leaving the sump 17 back into the tank 2.

In the embodiment of FIG. 1, the two intake pipes 9 are fluidically connected to the corresponding inlet mouths 24 and lie on the outside of the body 16 of the high-pressure pump 7. The two pipes 9 are completely distinct from one another and also from the lubrication and/or cooling pipe 10. Also the two delivery pipes 31 are completely distinct from one another and from the recirculation pipe 37. Consequently, each intake valve 14 and exhaust valve 15 is fluidically set between the respective pumping element 13 and the respective intake pipe 9 or delivery pipe 31, and is housed in the proximity of the respective outlet mouth 24, 25 within the body 16 of the high-pressure pump 7.

In a variant of the embodiment of FIG. 1, the function of non-return valve 33 and the function of flow regulator 29' can be integrated in a single device by appropriately sizing the section of passage of the flow of the non-return valve 33 and the loading of the spring 34. In this case, said device is set entirely within the body 16.

The outlet pipe 20 to the engine is provided with a regulation valve 38, which is governed according to the operating conditions of the engine for regulating in a known way the pressure of the fuel in the outlet pipe 20 and hence in the common rail of the injection system. The outlet of the regulation valve 38 is connected to the recirculation pipe 37 for discharging the fuel in excess pumped by the pump 7 into the tank 2.

In use, the fuel present in the tank 2 is drawn off and pre-compressed by the low-pressure pump 4, which via the circuit 6 sends it to the high-pressure pump 7. In particular, the fuel leaving the low-pressure pump 4 fills the pipe 9 and subsequently, via the union tee 11, according to proportions established by the flow regulator 29', in part flows in the union tee 28, and in part flows to the inlet mouth 26 of the internal pipe 32 for lubrication and cooling of the sump 17.

The fuel that flows in the internal pipe 32 reaches the body 16 of the high-pressure pump 7 through the non-return valve 33, fills the sump 17, and lubricates and cools the pumping elements 13, the cam 18, and the drive shaft 19. The fuel that has cooled and lubricated the sump 17, leaves the body 16 via the outlet mouth 35, thus filling the recirculation pipe 37, through which it is sent back into the tank 2. In turn, the fuel that flows in the connector pipe 27, via the union tee 28, fills each supply pipe 9, and reaches the body 16 via the respective inlet mouths 24.

The fuel that enters the body 16 via each inlet mouth 24, supplies, through the respective intake valve 14, the respective pumping element 13, by which it is compressed up to a given pressure. The fuel compressed by each pumping element 13 leaves the body 16 through the respective exhaust valve 15 and the respective outlet mouth 25, filling the respective delivery pipes 31. The fuel that flows in each delivery pipe 31, via the union tee 30 collects in the outlet pipe 20 for supplying the internal-combustion engine.

If for any reason the supply pressure of the fuel in the circuit 6 drops, the spring 34 closes the non-return valve 33, preventing the pumping elements 13 from sucking the fuel in from the sump 17, and preventing the mechanisms 13, 18, 19 inside it from remaining without any lubrication and cooling, and hence subject to seizing and/or to a marked increase in temperature.

In the embodiment of FIG. 2, the parts similar to those of FIG. 1 are designated by the same reference numbers, and the corresponding description will not be repeated herein. The main difference with respect to the embodiment of FIG. 1 consists in the fact that the supply pipes 9 are completely internal to the body 16, so that there is just one inlet mouth 39 for the two pipes 9 and just one outlet mouth 40 for the two delivery pipes 31.

Furthermore, the regulation of the pressure of the fuel pumped by the pump 7 is made by regulating the flow rate or volume of fuel taken in by the pump 7 according to the operating conditions of the engine, by means of a modular actuator 41 of the VCV (volume-control valve) type, in itself known. The modular actuator 41 has an inlet end and an outlet end. In this case, the presence of the non-return valve 33 also serves to prevent any turbulence of the fuel in the sump 17 from being transmitted to the supply pipes 9. In this case, between the non-return valve 33 and the union tee 11 is set a flow and pressure regulator 29", which, in addition to performing the function of flow regulator, also performs the function of regulator of the pressure required at the ends of the VCV actuator 41, so as to guarantee to the latter correct operation at a pre-set pressure, for example of approximately 3 bar.

In a variant of the embodiment of FIG. 2, the function of non-return valve 33 and the function of flow and pressure regulator 29" can be integrated in a single device by appropriately sizing the section of passage of the flow of the non-return valve 33 and the preload of the spring 34. Also this device can be set entirely within the body 16.

Also in this case, in use, the fuel leaving the low-pressure pump 4 fills the pipe 8 and subsequently, via the union tee 11, according to proportions established by the flow and pressure regulator 29", flows in part in the connector pipe 27 and in part to the inlet mouth 26 of the internal pipe 32 for lubrication and cooling of the sump 17.

From an examination of the characteristics of the high-pressure pump 7 and of the compression assembly 5 built according to the present invention, the advantages that the invention affords are evident. In particular, the fuel entering the high-pressure pump 7, which traverses the intake valves 14 of the pumping elements 13, can never reach the sump 17 even in the case of a pressure drop in the supply pipe 6. The fuel that is to be compressed in the pumping elements 13 hence cannot be contaminated by possible machining swarf or by impurities present in the sump 17, so that the operation of the high-pressure pump 7 is without the faults deriving from the presence of impurities in the fuel and calls for less frequent and less costly maintenance interventions.

It is clear that modifications and variations can be made to the high-pressure pump 7 and to the compression assembly 5 described and illustrated herein, without departing from the scope of protection defined in the claims. In particular, the embodiment of FIG. 1 can be without the pressure regulator 38 and the flow regulator 29' and be provided with a modular actuator 41 of the flow of fuel taken in and with the flow and pressure regulator 29". Likewise, the embodiment of FIG. 2 can be provided with the pressure regulator 38 and the flow regulator 29' and be without the modular actuator 41 of the flow of fuel taken in and without the flow/pressure regulator 29".

In addition, the circuit 6 can be made of non-thermoinsulating material and connected to the high-pressure pump 7 via means of thermoinsulating connection, or else the circuit 6 could be made of non-thermoinsulating material and constrained to one or more intermediate elements set at a distance from the high-pressure pump 7, sufficient to contain the heating of the fuel prior to entry into the pump 7 itself. Finally, the body 16 of the pump 7 can be made up of a number of pieces for constructional reasons as regards installation of the valves 14 and 15, and in particular as regards making the pipes 9 and 31 of FIG. 2 inside the body 16.

The invention claimed is:

1. In an internal-combustion engine compression system for supplying a fuel under pressure to said internal-combustion engine, said compression system comprising:

a high pressure pump (7) having a body (16) provided with an internal compartment (17) housing at least one pumping element (13) for providing a flow rate and a pressure to said fuel in an outlet pipe (20) and a mechanism (18, 19) for operating said pumping element (13); and fuel-supply means (14, 22) for delivering said fuel to said pumping element (13), said fuel-supply means (14, 22) communicating with a fuel supply pipe (9) supplied by an external fuel supply source (2) through a low pressure pump (4) and a delivery pipe (8), said fuel-supply means comprising at least one inlet mouth (24, 39) and an intake valve (14) located inside said body (16), another inlet mouth (26) supplied with said fuel directly from said delivery pipe (8) and fluidically connected to said internal compartment (17) to enable lubrication and/or cooling of a high pressure pump (7) with said fuel;

wherein said pumping element (13) is provided with fluid-exhaust means (15, 23) comprising an outlet mouth (25, 40) and an exhaust valve (15) located inside said body (16) and connected to said outlet pipe (20) through a delivery pipe (31), a non-return valve (33) being set on a pipe (32) communicating with said other inlet mouth (26) to prevent recycling of said, fuel from said compartment (17) to said pumping element (13), the improvements characterized in that said other inlet mouth (26) and said non-return valve (33) are within said body (16) in series with a flow regulator (29', 29"), said flow regulator (29', 29") having a fixed cross section sufficient for a flow of said fuel to lubricate and/or cool said compartment (17) and said mechanism (18, 19), and regulating means (38, 41) provides for regulating said pressure or flow rate of said fuel in said outlet pipe (20).

2. The compression system according to claim 1, characterized in that said non-return valve (33) is set on said pipe (32) within said body (16) and in series with said flow regulator (29', 29").

3. The compression system according to claim 2, characterized in that said non-return valve (33) and said flow regulator (29', 29") are arranged within said body (16).

4. The compression system according to claim 3, characterized in that said non-return valve (33) and said flow regulator (29', 29") are integrated in a single device (33, 29'; 33, 29") set entirely within said body (16).

5. The compression system according to claim 2, characterized in that said intake valve is connected to said external fuel supply source (2) through said fuel supply pipe (9).

6. The compression system according to claim 1, characterized in that it comprises at least a second pumping element, said pumping elements being associated with corresponding supply means (14, 24) and with corresponding exhaust means (15, 25), said supply means (14, 24) and said exhaust means (15, 25) being arranged within said body (16) in a position corresponding to the corresponding inlet mouths (24, 25).

7. The compression system according to claim 6, characterized in that said body (16) is provided with an outlet mouth in communication with said compartment (17), and an outlet mouth connected to said external fuel supply source through a recycling pipe (37) external to said body (16).

8. The compression system according to claim 7, characterized in that said regulating means (38, 41) comprise a regulation valve with variable flow rate between said outlet pipe (20) and said recirculating pipe (37), said regulation valve being controlled according to the operating conditions of said engine.

9. The compression system according to claim 7, characterized in that said regulating means comprise a modular actuator for regulating a flow rate of said fuel taken in by said high pressure pump (7), said modular actuator (41) being set between respective distribution means (6) and supply pipes (9), said modular actuator (41) being controlled according to operating conditions of said engine.

10. The compression system according to claim 9, characterized in that said modular actuator (41) is a VCV and has an inlet end and an outlet end, said regulator being a flow and pressure regulator (29") designed for regulating both the flow of fuel to said non-return valve (33) and the pressure at said ends the actuator (41).

* * * * *